US007874894B2

(12) United States Patent
Fukuda et al.

(10) Patent No.: US 7,874,894 B2
(45) Date of Patent: Jan. 25, 2011

(54) POLISHING PAD

(75) Inventors: Takeshi Fukuda, Osaka (JP); Junji Hirose, Osaka (JP); Yoshiyuki Nakai, Osaka (JP); Tsuyoshi Kimura, Osaka (JP)

(73) Assignee: Toyo Tire & Rubber Co., Ltd., Osaka-shi (JP)

( * ) Notice: Subject to any disclaimer, the term of this patent is extended or adjusted under 35 U.S.C. 154(b) by 0 days.

(21) Appl. No.: 12/294,402

(22) PCT Filed: May 15, 2007

(86) PCT No.: PCT/JP2007/059969

§ 371 (c)(1),
(2), (4) Date: Sep. 24, 2008

(87) PCT Pub. No.: WO2007/132854

PCT Pub. Date: Nov. 22, 2007

(65) Prior Publication Data

US 2009/0137189 A1 May 28, 2009

(30) Foreign Application Priority Data

May 17, 2006 (JP) ..... 2006-137353

(51) Int. Cl.
*B24B 49/00* (2006.01)

(52) U.S. Cl. ..... 451/6; 451/41; 451/526; 451/527; 451/533

(58) Field of Classification Search ..... 451/6, 451/41, 285, 287, 526, 527, 530, 533
See application file for complete search history.

(56) References Cited

U.S. PATENT DOCUMENTS

| | | | | |
|---|---|---|---|---|
| 5,605,760 | A | 2/1997 | Roberts | |
| 5,893,796 | A | 4/1999 | Birang et al. | |
| 6,454,630 | B1 | 9/2002 | Tolles | |
| 6,524,164 | B1 | 2/2003 | Tolles | |
| 6,832,947 | B2 * | 12/2004 | Manning | 451/41 |
| 6,855,034 | B2 * | 2/2005 | Hasegawa | 451/41 |
| 6,960,120 | B2 * | 11/2005 | Prasad | 451/41 |

(Continued)

FOREIGN PATENT DOCUMENTS

EP 0824995 2/1998

(Continued)

OTHER PUBLICATIONS

International Search Report mailed Jun. 12, 2007, directed to PCT/JP2007/059969; 2 pages.

(Continued)

*Primary Examiner*—Eileen P. Morgan
(74) *Attorney, Agent, or Firm*—Morrison & Foerster LLP

(57) ABSTRACT

A polishing pad provides excellent optical detection accuracy properties over a broad wavelength range (particularly at the short-wavelength side) and is capable of preventing a slurry from leaking from the boundary between a polishing region and a light-transmitting region. The polishing pad includes at least a transparent support film laminated on one side of a polishing layer including a polishing region and a light-transmitting region; the light transmittance of an optical detection region containing at least the light-transmitting region and the transparent support film is 40% or more in the overall range of wavelengths of 300 to 400 nm.

4 Claims, 1 Drawing Sheet

U.S. PATENT DOCUMENTS

| | | | | |
|---|---|---|---|---|
| 6,984,163 | B2 * | 1/2006 | Roberts | 451/6 |
| 7,195,539 | B2 * | 3/2007 | Turner et al. | 451/6 |
| 7,226,339 | B2 * | 6/2007 | Benvegnu et al. | 451/6 |
| 7,238,097 | B2 * | 7/2007 | Ohno et al. | 451/527 |
| 7,306,507 | B2 * | 12/2007 | Benvegnu et al. | 451/6 |
| 7,435,165 | B2 * | 10/2008 | Prasad | 451/526 |
| 2003/0084774 | A1 | 5/2003 | David | |
| 2003/0109197 | A1 | 6/2003 | Tolles | |
| 2003/0171070 | A1 | 9/2003 | Tolles | |
| 2003/0171081 | A1 * | 9/2003 | Komukai et al. | 451/285 |
| 2004/0157534 | A1 * | 8/2004 | Manning | 451/41 |
| 2004/0224611 | A1 * | 11/2004 | Aoi et al. | 451/6 |
| 2004/0235392 | A1 | 11/2004 | Ohta | |
| 2005/0248881 | A1 * | 11/2005 | Hayashida et al. | 360/131 |
| 2006/0037699 | A1 | 2/2006 | Nakamori et al. | |
| 2006/0154568 | A1 | 7/2006 | Tolles | |
| 2008/0008971 | A1 | 1/2008 | Shiba et al. | |

FOREIGN PATENT DOCUMENTS

| | | |
|---|---|---|
| JP | 9-7985 | 1/1997 |
| JP | 10-83977 | 3/1998 |
| JP | 11-512977 | 11/1999 |
| JP | 2001-291686 | 10/2001 |
| JP | 2003-68686 | 3/2003 |
| JP | 2003-510826 | 3/2003 |
| JP | 2004-297061 | 10/2004 |
| JP | 2005-322790 | 11/2005 |
| JP | 2006-45523 | 2/2006 |
| JP | 2006-102940 | 4/2006 |
| WO | WO-01/23141 | 4/2001 |
| WO | WO-2004/049417 | 6/2004 |
| WO | WO-2006/001518 | 1/2006 |

OTHER PUBLICATIONS

Chinese Office Action dated Feb. 26, 2010, directed towards counterpart Chinese Application No. 200780017751.2; 10 pages.

Taiwanese Office Action dated Jan. 19, 2010, directed towards corresponding Taiwan Patent Application No. 096117369; 10 pages.

* cited by examiner

POLISHING PAD

REFERENCE TO RELATED APPLICATIONS

This application is a national stage application under 35 USC 371 of International Application No. PCT/JP2007/059969, filed May 15, 2007, which claims the priority of Japanese Patent Application No. 2006-137353, filed May 17, 2006, the contents of both of which prior applications are incorporated herein by reference.

FIELD OF THE INVENTION

The present invention relates to a method for manufacturing a polishing pad by which the planarizing processing of optical materials such as lenses, reflecting mirrors and the like, silicon wafers, glass substrates for hard disks, aluminum substrates, and materials requiring a high degree of surface planarity such as those in general metal polishing processing can be carried out stably with high polishing efficiency. The polishing pad obtained by the manufacturing method of the present invention is used particularly preferably in a process of planarizing a silicone wafer, and a device having an oxide layer, a metal layer or the like formed on a silicon wafer, before lamination and formation of the oxide layer, the metal layer or the like.

BACKGROUND OF THE INVENTION

Production of a semiconductor device involves a step of forming an electroconductive film on the surface of a wafer to form a wiring layer by photolithography, etching etc., a step of forming an interlaminar insulating film on the wiring layer, etc., and an uneven surface made of an electroconductive material such as metal and an insulating material is generated on the surface of a wafer by these steps. In recent years, processing for fine wiring and multilayer wiring is advancing for the purpose of higher integration of semiconductor integrated circuits, and accordingly techniques of planarizing an uneven surface of a wafer have become important.

As the method of planarizing an uneven surface of a wafer, a CMP method is generally used. CMP is a technique wherein while the surface of a wafer to be polished is pressed against a polishing surface of a polishing pad, the surface of the wafer is polished with an abrasive in the form of slurry having abrasive grains dispersed therein (hereinafter, referred to as slurry). As shown in FIG. 1, a polishing apparatus used generally in CMP is provided for example with a polishing platen 2 for supporting a polishing pad 1, a supporting stand (polishing head) 5 for supporting a polished material (wafer) 4, a backing material for uniformly pressurizing a wafer, and a mechanism of feeding an abrasive. The polishing pad 1 is fitted with the polishing platen 2 for example via a double-coated tape. The polishing platen 2 and the supporting stand 5 are provided with rotating shafts 6 and 7 respectively and are arranged such that the polishing pad 1 and the polished material 4, both of which are supported by them, are opposed to each other. The supporting stand 5 is provided with a pressurizing mechanism for pushing the polished material 4 against the polishing pad 1.

When such CMP is conducted, there is a problem of judging the planarity of wafer surface. That is, the point in time when desired surface properties or planar state are reached should be detected. With respect to the thickness of an oxide film, polishing speed etc., the polishing treatment of a test wafer has been conducted by periodically treating the wafer, and after the results are confirmed, a wafer serving as a product is subjected to polishing treatment.

In this method, however, the treatment time of a test wafer and the cost for the treatment are wasteful, and a test wafer and a product wafer not subjected to processing are different in polishing results due to a loading effect unique to CMP, and accurate prediction of processing results is difficult without actual processing of the product wafer.

Accordingly, there is need in recent years for a method capable of in situ detection of the point in time when desired surface properties and thickness are attained at the time of CMP processing, in order to solve the problem described above. For such detection, various methods have been used, and from the viewpoint of measurement accuracy and spatial resolution in non-contact measurement, an optical detection means is becoming the mainstream.

The optical detection means is specifically a method of detecting the end-point of polishing by irradiating a wafer via a polishing pad through a window (light-transmitting region) with a light beam, and monitoring an interference signal generated by reflection of the light beam.

As the light beam, a white light using a halogen lamp having a light of wavelengths of 300 to 800 nm is generally used at present.

In such method, the end-point is determined by knowing an approximate depth of surface unevenness through monitoring of a change in the thickness of a surface layer of a wafer. When such change in thickness becomes equal to the thickness of the unevenness, the CMP process is finished. As a method of detecting the end-point of polishing by such optical means and a polishing pad used in the method, various methods and polishing pads have been proposed.

For example, a polishing pad having, as least a part thereof, a solid and uniform transparent polymer sheet passing a light of wavelengths of 190 nm to 3500 nm therethrough is disclosed (Patent Literature 1). Further, a polishing pad having a stepped transparent plug inserted therein is disclosed (Patent Literature 2). A polishing pad having a transparent plug on the same surface as a polishing surface is disclosed (Patent Literature 3).

As described above, a white light using a halogen lamp or the like is used as the light beam, and when the white light is used, there is an advantage that the light of various wavelengths can be applied onto a wafer, and many profiles of the surface of the wafer can be obtained. When this white light is used as the light beam, detection accuracy should be increased in a broad wavelength range. However, a polishing pad having a conventional window (light-transmitting region) has a problem that the polishing pad is very poor in detection accuracy at the short-wavelength side (ultraviolet region) and causes mechanical errors in detection of the optical end-point. In high integration and micronization in production of semiconductors in the future, the wiring width of an integrated circuit is expected to be further decreased, for which highly accurate optical end-point detection is necessary, but the conventional window for end-point detection does not have sufficiently satisfactory accuracy in a broad wavelength range (particularly at the short-wavelength side).

Meanwhile, there are proposals for preventing a slurry from leaking from the boundary (joint) between a polishing region and a light-transmitting region (Patent Literatures 4 and 5). For preventing slurry leakage, a method of arranging a transparent film coated on the upper side and underside thereof with an adhesive between an upper-layer pad and a lower-layer pad is disclosed (Patent Literature 6). However, the above-mentioned problem of low detection accuracy at the short-wavelength side has never been solved.

Patent Literature 1: JP-A 11-512977
Patent Literature 2: JP-A 9-7985
Patent Literature 3: JP-A 10-83977
Patent Literature 4: JP-A 2001-291686
Patent Literature 5: JP-A 2003-510826
Patent Literature 6: JP-A 2003-68686

SUMMARY OF THE INVENTION

One object of the present invention is to provide a polishing pad excellent in optical detection accuracy in a broad wavelength range (particularly at the short-wavelength side) and capable of preventing a slurry from leaking from the boundary between a polishing region and a light-transmitting region. Another object of the present invention is to provide a method for manufacturing a semiconductor device which comprises a process of polishing the surface of a semiconductor wafer with the polishing pad.

In view of the existing circumstances as described above, the present inventors made intensive studies and found that the problems can be solved by the following polishing pad.

That is, the present invention relates to a polishing pad comprising at least a transparent support film laminated on one side of a polishing layer including a polishing region and a light-transmitting region, wherein the light transmittance of an optical detection region containing at least the light-transmitting region and the transparent support film is 40% or more in the overall range of wavelengths of 300 to 400 nm.

As the intensity attenuation of a light passing through the optical detection region of the polishing pad is decreased, the accuracy of detection of a polishing end-point and the accuracy of measurement of film thickness can be increased. Accordingly, the degree of light transmittance in the wavelength of a measurement light used is important for determining the accuracy of detection of a polishing end-point and the accuracy of measurement of film thickness. In the optical detection region of the present invention, the attenuation of light transmittance is low particularly at the short-wavelength side, and detection accuracy can be kept high in a broad wavelength range. The optical detection region is a region through which a light beam irradiated by a film thickness measuring instrument and a light beam reflected by the surface of a wafer are transmitted, and contains at least a light-transmitting region and a transparent support film.

As described above, a generally used film thickness measuring instrument makes use of a laser having an oscillation wavelength in the vicinity of 300 to 800 nm so that when the light transmittance in the optical detection region particularly at the short-wavelength side (300 to 400 nm) is 40% or more, high reflected light can be obtained, and the accuracy of detection of an end-point and the accuracy of detection of film thickness can be significantly improved. The light transmittance at the short-wavelength side is preferably 45% or more, more preferably 50% or more. The light transmittance in the present invention is the transmittance of the optical detection region having a thickness of 1 mm or a thickness reduced to 1 mm. According to the Lambert-Beer law, the light transmittance of an object is generally changed depending on the thickness of the object. Because the light transmittance is decreased as the thickness is increased, the light transmittance of an object with its thickness fixed should be determined.

In the present invention, the density of aromatic rings in the polymer as a main material of each member constituting the optical detection region is preferably 2 wt % or less in total, more preferably 1 wt % or less. By allowing the density of aromatic rings in the polymer as a main material of each member (the light-transmitting region, the transparent support film or the like) constituting the optical detection region to be 2 wt % or less in total, the light transmittance of the optical detection region in the overall range of wavelengths of 300 to 400 nm can be regulated to be 40% or more. The density of aromatic rings refers to the weight proportion of aromatic rings in the polymer.

Preferably, the polymer as a main material of the light-transmitting region is a polyurethane resin, and an isocyanate component of the polyurethane resin is at least one member selected from the group consisting of 1,6-hexamethylenediisocyanate, 4,4'-dicyclohexylmethanediisocyanate, and isophoronediisocyanate. The polyurethane resin containing the above-mentioned isocyanate component is preferable as a main material of the light-transmitting region because of its low aromatic ring density.

The polymer as a main material of the transparent support film is preferably at least one member selected from the group consisting of polypropylene, polyethylene, aliphatic polyamide, polymethyl acrylate, polymethyl methacrylate, and polyvinyl chloride. The above-mentioned polymer is free of an aromatic ring and thus preferable as a main material of the transparent support film.

In the present invention, the material forming the light-transmitting region is preferably a non-foam. The non-foam can prevent light scattering, is thus capable of detecting accurate reflectance and capable of improving the accuracy of detection of the optical end-point of polishing.

The surface of the light-transmitting region at the polishing side does not have an uneven structure for retaining and renewing an abrasive liquid. When macroscopic surface unevenness is present on the surface of the light-transmitting region at the polishing side, a slurry containing additives such as abrasive grains may be accumulated in its concave portions to cause light scattering and absorption to exert an influence on detection accuracy. Preferably, the other surface of the light-transmitting region does not have macroscopic surface unevenness, either. This is because when macroscopic surface unevenness is present, light scattering easily occurs, which may exert an influence on detection accuracy.

In the present invention, the material for forming the polishing region is preferably a fine-cell foam.

The average cell diameter of the fine-cell foam is preferably 70 μm or less, more preferably 50 μm or less. When the average cell diameter is 70 m or less, planarity is improved.

The specific gravity of the fine-cell foam is preferably 0.5 to 1, more preferably 0.7 to 0.9. When the specific gravity is less than 0.5, the strength of the surface of the polishing region is lowered to reduce the planarity of a polished material, while when the specific gravity is greater than 1, the number of fine cells on the surface of the polishing region is decreased, and the rate of polishing tends to be decreased even though planarity is good.

The Asker D hardness of the fine-cell foam is preferably 40 to 70 degree, more preferably 45 to 60 degree. When the Asker D hardness is less than 40 degree, the planarity of a polished material is decreased, while when the Asker D hardness is greater than 70 degree, the planarity is good, but the uniformity of a polished material tends to be decreased.

The present invention relate to a method of producing a semiconductor device, which comprises a step of polishing the surface of a semiconductor wafer with the polishing pad described above.

DETAILED DESCRIPTION OF THE INVENTION

Figure 1:
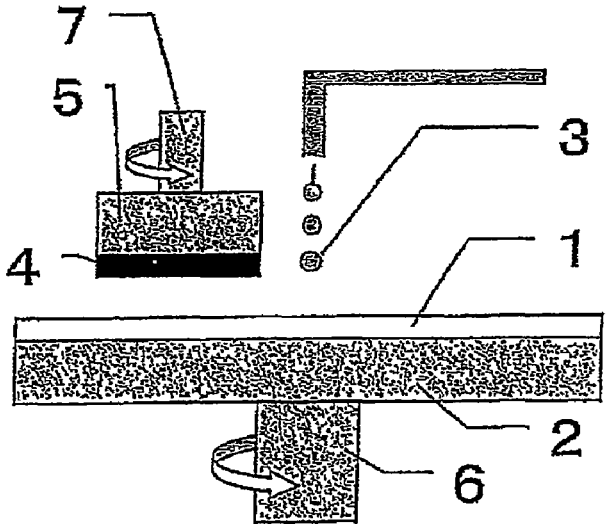
FIG. 1 is a schematic illustration showing one example of a conventional polishing apparatus used in CMP polishing.

The polishing pad of the present invention has at least a transparent support film on one side of a polishing layer including a polishing region and a light-transmitting region. In addition, the light transmittance of an optical detection region containing at least the light-transmitting region and the transparent support film should be 40% or more in the overall range of wavelengths of 300 to 400 nm.

The polymer as a material for forming the light-transmitting region is not particularly limited insofar as it is a material exhibiting the properties described above, and examples of such material include a polyurethane resin, a polyester resin, a polyamide resin, an acrylic resin, a halogenated resin (polyvinyl chloride, polytetrafluoroethylene, polyvinylidene fluoride or the like), an olefinic resin (polyethylene, polypropylene or the like), and an epoxy resin. These resins may be used alone or as a mixture of two or more thereof. Among these materials, a polymer having a low aromatic ring density is preferably used, and particularly, a polyurethane resin having a low aromatic ring density is preferably used. The polyurethane resin is a preferable material because it is highly abrasion-resistant and capable of suppressing the light scattering in the light-transmitting region caused by dressing trace during polishing.

The polyurethane resin is constituted of an isocyanate component, a polyol component (a high-molecular-weight polyol and a low-molecular-weight polyol) and a chain extender.

As the isocyanate component, a compound known in the field of polyurethane can be used without particular limitation. The isocyanate component includes, for example, aromatic diisocyanates such as 2,4-toluene diisocyanate, 2,6-toluene diisocyanate, 2,2'-diphenyl methane diisocyanate, 2,4'-diphenyl methane diisocyanate, 4,4'-diphenyl methane diisocyanate, 1,5-naphthalene diisocyanate, p-phenylene diisocyanate, m-phenylene diisocyanate, p-xylylene diisocyanate and m-xylylene diisocyanate, aliphatic diisocyanates such as ethylene diisocyanate, 2,2,4-trimethyl hexamethylene diisocyanate and 1,6-hexamethylene diisocyanate, and alicyclic diisocyanates such as 1,4-cyclohexane diisocyanate, 4,4'-dicyclohexyl methane diisocyanate, isophorone diisocyanate and norbornane diisocyanate. These may be used alone or as a mixture of two or more thereof. Among these components, aliphatic diisocyanates and/or alicyclic diisocyanates are preferably used to reduce the density of aromatic rings, and particularly, at least one diisocyanate selected from the group consisting of 1,6-hexamethylene diisocyanate, 4,4'-dicyclohexylmethane diisocyanate, and isophorone diisocyanate is preferably used.

As the high-molecular-weight polyol, a compound known in the field of polyurethane can be used without particular limitation. The high-molecular-weight polyol includes, for example, polyether polyols represented by polytetramethylene ether glycol and polyethylene glycol, polyester polyols represented by polybutylene adipate, polyester polycarbonate polyols exemplified by reaction products of polyester glycols such as polycaprolactone polyol and polycaprolactone with alkylene carbonate, polyester polycarbonate polyols obtained by reacting ethylene carbonate with a multivalent alcohol and reacting the resulting reaction mixture with an organic dicarboxylic acid, and polycarbonate polyols obtained by ester exchange reaction of a polyhydroxyl compound with aryl carbonate. These may be used singly or as a mixture of two or more thereof. Among these, high-molecular-weight polyols not having an aromatic ring are preferably used to decrease the density of aromatic rings. For improving light transmittance, high-molecular-weight polyols not having a long resonance structure or high-molecular-weight polyols not having so much skeleton structure having high electron-withdrawing and electron-donating properties are preferably used.

Examples of the low-molecular-weight polyol that can be used together with a high-molecular-weight polyol described above include: ethylene glycol, 1,2-propylene glycol, 1,3-propylene glycol, 1,4-butanediol, 1,6-hexanediol, neopentyl glycol, 1,4-cyclohexanedimethanol, 3-methyl-1,5-pentanediol, diethylene glycol, triethyleneglycol and the like. Other examples that can be used together with the high-molecular-weight polyol also include: low-molecular-weight polyamine such as ethylenediamine, diethylenetriamine and the like. To reduce the density of aromatic rings, low-molecular-weight polyols not having an aromatic ring or low-molecular-weight polyamines not having an aromatic ring are preferably used.

Concrete examples of the chain extender include: aromatic polyamines such as 4,4'-methylenebis(o-chloroaniline) (MOCA), 2,6-dichloro-p-phenylenediamine, 4,4'-methylenebis(2,3-dichloroaniline), 3,5-bis(methylthio)-2,4-toluenediamine, 3,5-bis(methylthio)-2,6-toluenediamine, 3,5-diethyltoluene-2,4-diamine, 3,5-diethyltoluene-2,6-diamine, trimethylene glycol-di-p-aminobenzoate, 1,2-bis(2-aminophenylthio)ethane, 4,4'-diamino-3,3'-diethyl-5.5'-dimethyldiphenylmethane, N,N'-di-sec-butyl-4,4'-diaminophenylmethane, 3,3'-diethyl-4,4'-diaminodiphenylmethane, m-xylylenediamine, N,N'-di-sec-butyl-p-phenylenediamine, m-phenylenediamine and p-xylylenediamine; low-molecular-weight polyols; and low-molecular-weight polyamines. The chain extenders described above may be used either alone or in mixture of two kinds or more. In order to reduce the density of aromatic rings in the polyurethane resin, however, the aromatic polyamines are preferably not used, but may be incorporated in such a range that the light transmission characteristics are not deteriorated.

The proportion of the isocyanate component, the polyol component and the chain extender in the polyurethane resin can be changed suitably depending on their respective molecular weights, desired physical properties of the light-transmitting region produced therefrom, etc. To allow the light-transmitting region to achieve the above properties, the ratio of the number of isocyanate groups of the isocyanate component to the number of functional groups in total (hydroxyl group+amino group) in the polyol and the chain extender is preferably 0.95 to 1.15, more preferably 0.99 to 1.10.

The polyurethane resin can be polymerized by known urethane-making techniques such as a melting method, a solution method etc., but in consideration of cost and working atmosphere, the polyurethane resin is formed preferably by the melting method. A stabilizer such as an antioxidant etc., a surfactant, a lubricant, a pigment, a filler, an antistatic and other additives may be added if necessary to the polyurethane resin.

The polyurethane resin can be produced by a prepolymer method or a one-shot method, but the prepolymer method wherein an isocyanate-terminated prepolymer synthesized previously from an isocyanate component and a polyol component is reacted with a chain extender is preferably used.

The method of preparing the light-transmitting region is not particularly limited, and the light-transmitting region can be prepared according to methods known in the art. For example, a method wherein a block of polyurethane resin produced by the method described above is cut in a predetermined thickness by a slicer in a handsaw system or a planing system, a method that involves casting resin into a mold having a cavity of predetermined thickness and then curing the resin, a method of using coating techniques and sheet molding techniques, etc. are used. When there are bubbles in the light-transmitting region, the decay of reflected light becomes significant due to light scattering, thus reducing the accuracy of detection of polishing endpoint and the accuracy of measurement of film thickness. Accordingly, gas contained in the material before mixing is sufficiently removed under reduced pressure at 10 Torr or less. In the case of a usually used stirring blade mixer, the mixture is stirred at a revolution number of 100 rpm or less so as not to permit bubbles to be incorporated into it in the stirring step after mixing. The stirring step is also preferably conducted under reduced pressure. When a rotating mixer is used, bubbles are hardly mixed even in high rotation, and thus a method of stirring and defoaming by using this mixer is also preferable.

The shape and size of the light-transmitting region are not particularly limited, but are preferably similar to the shape and size of the opening of the polishing region.

The thickness of the light-transmitting region is preferably equal to or less than that of the polishing region. When the light-transmitting region is thicker than the polishing region, a wafer may be damaged by a protruded portion during polishing. On the other hand, when the light-transmitting region is too thin, durability becomes insufficient. The abradability of the light-transmitting region is preferably equal to or less than that of the polishing region. When the light-transmitting region is less abraded than the polishing region, a wafer may be damaged by a protruded portion during polishing.

The polymer as a material for forming the transparent support film is not particularly limited insofar as it is a material exhibiting the characteristics described above, but the polymer is preferably a highly transparent, heat-resistant and pliable polymer. Specific examples can include polyester; polyethylene; polypropylene; polyacrylate; polymethacrylate; polyamide; polyimide; polyvinyl alcohol; polyvinyl chloride; fluorine-containing resins such as polyfluoroethylene; nylon; cellulose; general-purpose engineering plastics such as polycarbonate; special engineering plastics such as polyether imide, polyether ether ketone and polyether sulfone. To reduce the density of aromatic rings, a polymer not having an aromatic ring is preferably used, and particularly at least one member selected from the group consisting of polypropylene, polyethylene, aliphatic polyamide, polymethyl acrylate, polymethyl methacrylate, and polyvinyl chloride is preferably used.

The thickness of the transparent support film is not particularly limited, but from the viewpoint of strength and rolling, the thickness is preferably about 20 to 200 μm. The surface of the transparent support film may be subjected to corona discharge treatment.

The material for forming the polishing region can be used without particular limitation insofar as it is usually used as the material of a polishing layer, but in the present invention, fine-cell foam is preferably used. When the fine-cell foam is used, slurry can be retained on cells of the surface to increase the rate of polishing.

The material for forming the polishing region includes, for example, polyurethane resin, polyester resin, polyamide resin, acrylic resin, polycarbonate resin, halogenated resin (polyvinyl chloride, polytetrafluoroethylene, polyvinylidene fluoride etc.), polystyrene, olefinic resin (polyethylene, polypropylene etc.), epoxy resin, and photosensitive resin.

These may be used alone or as a mixture of two or more thereof. The polyurethane resin is a particularly preferable material because it is excellent in abrasion resistance and a polyurethane polymer having desired physical properties can be easily obtained by changing its raw material composition. The starting materials of the polyurethane resin are the same as described above.

The polyurethane resin can be produced by the same method as described above.

The method of finely foaming the polyurethane resin includes, but is not limited to, a method of adding hollow beads and a method of forming foam by mechanical foaming, chemical foaming etc. These methods can be simultaneously used, but the mechanical foaming method using an active hydrogen group-free silicone-based surfactant consisting of a polyalkyl siloxane/polyether copolymer is more preferable. As the silicone-based surfactant, SH-192 and L-5340 (Toray Dow Corning Silicone Co., Ltd.) can be mentioned as a preferable compound.

Description will be given of an example of a method of producing a polyurethane foam of a fine cell type constituting a polishing region below. A method of manufacturing such a polyurethane foam has the following steps:

1) a foaming step of preparing a bubble dispersion liquid of an isocyanate-terminated prepolymer, wherein a silicone-based surfactant is added into an isocyanate-terminated prepolymer, which is agitated in the presence of a non-reactive gas to thereby disperse the non-reactive gas into the prepolymer as fine bubbles and obtain a bubble dispersion liquid. In a case where the prepolymer is solid at an ordinary temperature, the prepolymer is preheated to a proper temperature and used in a molten state.

2) a curing agent (chain extender) mixing step, wherein a chain extender is added into the bubble dispersion liquid, which is agitated to thereby obtain a foaming reaction liquid.

3) a casting step, wherein the forming reaction liquid is cast into a mold.

4) a curing step, wherein the foaming reaction liquid having been cast into the mold is heated and reaction-cured.

The inert gas used for forming fine cells is preferably not combustible, and is specifically nitrogen, oxygen, a carbon dioxide gas, a rare gas such as helium and argon, and a mixed gas thereof, and the air dried to remove water is most preferable in respect of cost.

As a stirrer for dispersing the silicone-based surfactant-containing isocyanate-terminated prepolymer to form fine cells with the inert gas, known stirrers can be used without particular limitation, and examples thereof include a homogenizer, a dissolver, a twin-screw planetary mixer etc. The shape of a stirring blade of the stirrer is not particularly limited either, but a whipper-type stirring blade is preferably used to form fine cells.

In a preferable mode, different stirrers are used in stirring for forming a cell dispersion in the stirring step and in stirring for mixing an added chain extender in the mixing step, respectively. In particular, stirring in the mixing step may not be stirring for forming cells, and a stirrer not generating large cells is preferably used. Such a stirrer is preferably a planetary mixer. The same stirrer may be used in the stirring step and the mixing step, and stirring conditions such as revolution rate of the stirring blade are preferably regulated as necessary.

In the method of producing the polyurethane foam, heating and post-curing of the foam obtained after casting and reacting the forming reaction liquid in a mold until the dispersion lost fluidity are effective in improving the physical properties of the foam, and are extremely preferable. The forming reaction liquid may be cast in a mold and immediately post-cured in a heating oven, and even under such conditions, heat is not immediately conducted to the reactive components, and thus the diameters of cells are not increased. The curing reaction is conducted preferably at normal pressures to stabilize the shape of cells.

In the production of the polyurethane resin, a known catalyst promoting polyurethane reaction, such as tertiary amine- or organotin-based catalysts, may be used. The type and amount of the catalyst added are determined in consideration of flow time in casting in a predetermined mold after the mixing step.

Production of the polyurethane foam may be in a batch system where each component is weighed out, introduced into a vessel and mixed or in a continuous production system where each component and an inert gas are continuously supplied to, and stirred in, a stirring apparatus and the resulting cell dispersion is transferred to produce molded articles.

The polishing region is produced by cutting the above prepared polyurethane foam into a piece of predetermined size.

The polishing region consisting of fine-cell foam is preferably provided with grooves for retaining and renewing slurry on the surface of the polishing pad which contacts with a polished material. The polishing region composed of fine-cell foam has many openings to retain slurry, and for further efficient retention and renewal of slurry and for preventing the destruction of a polished material by adsorption, the polishing region preferably has grooves on the surface thereof in the polishing side. The shape of the grooves is not particularly limited insofar as slurry can be retained and renewed, and examples include latticed grooves, concentric circle-shaped grooves, through-holes, non-through-holes, polygonal prism, cylinder, spiral grooves, eccentric grooves, radial grooves, and a combination of these grooves. The groove pitch, groove width, groove thickness etc. are not particularly limited either, and are suitably determined to form grooves. These grooves are generally those having regularity, but the groove pitch, groove width, groove depth etc. can also be changed at each certain region to make retention and renewal of slurry desirable.

The method of forming grooves is not particularly limited, and for example, formation of grooves by mechanical cutting with a jig such as a bite of predetermined size, formation by casting and curing resin in a mold having a specific surface shape, formation by pressing resin with a pressing plate having a specific surface shape, formation by photolithography, formation by a printing means, and formation by a laser light using a $CO_2$ gas laser or the like.

Although the thickness of the polishing region is not particularly limited, the thickness is about 0.8 to 4 mm, preferably 1 to 2 mm. The method of preparing the polishing region of this thickness includes a method wherein a block of the polyurethane foam is cut in predetermined thickness by a slicer in a bandsaw system or a planing system, a method that involves casting resin into a mold having a cavity of predetermined thickness and curing the resin, a method of using coating techniques and sheet molding techniques, etc.

Figure 2:
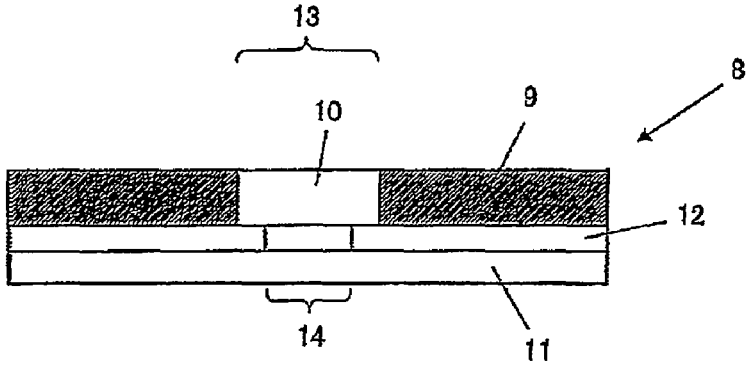
FIG. 2 is a schematic sectional view showing one example of the polishing pad of the present invention.
Figure 3:
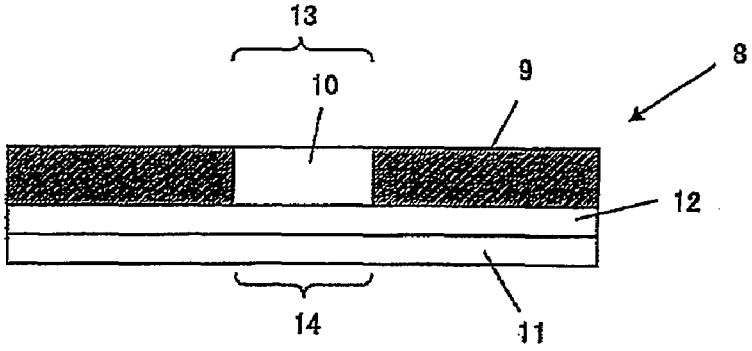
FIG. 3 is a schematic sectional view showing another example of the polishing pad of the present invention.

FIGS. 2 and 3 are sectional views of a polishing pad 8 of the present invention. The method for manufacturing the polishing pad is not particularly limited, and various methods are conceivable. Hereinafter, examples of such methods are described.

Case 1 (FIG. 2)

An opening 13 for arranging a light-transmitting region 10 is formed in a polishing region 9. An adhesive layer 12 is formed on one side of the polishing region 9, and the adhesive layer 12 is punched out to form a hole having a size corresponding to an optical detection region 14. Thereafter, a transparent support film 11 is attached to the adhesive layer 12, and the light-transmitting region 10 is inserted into the opening 13 and attached to the adhesive layer 12. In this case, the optical detection region 14 is composed of the light-transmitting region 10 and the transparent support film 11.

Case 2 (FIG. 3)

An opening 13 for arranging a light-transmitting region 10 is formed in a polishing region 9. An adhesive layer 12 is formed on one side of a transparent support film 11, and the polishing region 9 is attached to the adhesive layer 12. Thereafter, the light-transmitting region 10 is inserted into the opening 13 and attached to the adhesive layer 12. In this case, an optical detection region 14 is composed of the light-transmitting region 10, the transparent support film 11 and the adhesive layer 12.

In the method of preparing the polishing pad, the means of forming an opening in the polishing region and the adhesive layer is not particularly limited, but for example, a method of opening by pressing with a jig having a cutting ability, a method of utilizing a laser such as a $CO_2$ laser, and a method of cutting with a jig such as a bite. The size and shape of the opening of the polishing region are not particularly limited.

The adhesive layer 12 includes, for example, a double-sided tape or a layer coated with a cured adhesive. As the double-sided tape, it is possible to use a general double-sided tape having an adhesive layer arranged on both sides of a substrate such as a nonwoven fabric or a film. In consideration of preventing permeation with a slurry or the like, a film is preferably used as the substrate. The adhesive as a raw material of the adhesive layer includes, for example, general adhesives such as a rubber-based adhesive and an acrylic adhesive. However, when the optical detection region 14 contains the adhesive layer 12 as in the case 2 above, the substrate of the double-sided tape is formed preferably from a non-aromatic polymer such as cellulose, polyethylene and polypropylene in order that the light transmittance of the optical detection region 14 becomes 40% or more in the overall range of wavelengths of 300 to 400 nm. The base polymer of the adhesive is also preferably a polymer not containing an aromatic ring.

The polishing pad of the present invention may have a cushion sheet (cushion layer) laminated on one side of the transparent support film.

The cushion layer compensates for characteristics of the polishing layer. The cushion sheet is required for satisfying both planarity and uniformity which are in a tradeoff relationship in chemical mechanical polishing (CMP). Planarity refers to flatness of a pattern region upon polishing an object of polishing having fine unevenness generated upon pattern formation, and uniformity refers to the uniformity of the whole of an object of polishing. Planarity is improved by the characteristics of the polishing layer, while uniformity is improved by the characteristics of the cushion sheet. The cushion sheet used in the polishing pad of the present invention is preferably softer than the polishing region.

The material forming the cushion sheet is not particularly limited, and examples of such material include a nonwoven fabric such as a polyester nonwoven fabric, a nylon nonwoven fabric or an acrylic nonwoven fabric, a nonwoven fabric impregnated with resin such as a polyester nonwoven fabric impregnated with polyurethane, polymer resin foam such as polyurethane foam and polyethylene foam, rubber resin such as butadiene rubber and isoprene rubber, and photosensitive resin.

The means of attaching the transparent support film to the cushion sheet includes, for example, a method wherein the transparent support film is laminated via a double-sided tape on the cushion sheet and then pressed. However, the cushion sheet should be provided with an opening in a part corresponding to the optical detection region 14.

The polishing pad of the present invention may be provided with a double-sided tape at a side of the transparent support film or the cushion layer which is bonded to a platen.

The semiconductor device is produced by a step of polishing the surface of a semiconductor wafer by using the polishing pad. The semiconductor wafer generally comprises a wiring metal and an oxide film laminated on a silicon wafer. The method of polishing a semiconductor wafer and a polishing apparatus are not particularly limited, and as shown in FIG. 1, polishing is conducted for example by using a polishing apparatus including a polishing platen 2 for supporting a polishing pad 1, a supporting stand (polishing head) 5 for supporting a semiconductor wafer 4, a backing material for uniformly pressurizing the wafer, and a mechanism of feeding an abrasive 3. The polishing pad 1 is fitted, for example via a double-coated tape, with the polishing platen 2. The polishing platen 2 and the supporting stand 5 are provided with rotating shafts 6 and 7 and arranged such that the polishing pad 1 and the semiconductor wafer 4, both of which are supported by them, are arranged to be opposite to each other. The supporting stand 5 is provided with a pressurizing mechanism for pushing the semiconductor wafer 4 against the polishing pad 1. For polishing, the polishing platen 2 and the supporting stand 5 are rotated and simultaneously the semiconductor wafer 4 is polished by pushing it against the polishing pad 1 with slurry fed thereto. The flow rate of slurry, polishing loading, number of revolutions of the polishing platen, and number of revolutions of the wafer are not particularly limited and can be suitably regulated.

Protrusions on the surface of the semiconductor wafer 4 are thereby removed and polished flatly. Thereafter, a semiconductor device is produced therefrom through dicing, bonding, packaging etc. The semiconductor device is used in an arithmetic processor, a memory etc.

EXAMPLES

Hereinafter, the Examples illustrating the constitution and effect of the invention are described. Evaluation items in the Examples etc. were measured in the following manner.

(Measurement of Light Transmittance of Optical Detection Region)

Examples 1 to 8 and Comparative Examples 1 and 2

Each prepared light-transmitting region was cut out in a size of 10 mm×50 mm, and a double-sided tape of 1 mm in width (Double Tack Tape #5782, thickness 130 μm, manufactured by Sekisui Chemical Co., Ltd.) was attached around it. Thereafter, the transparent support film (10 mm×50 mm) used in the Examples and Comparative Examples was attached to the double-sided tape to prepare a sample for measurement of light transmittance.

Example 9

The prepared optical detection region was cut out in a size of 10 mm×50 mm to prepare a sample for measurement of light transmittance.

The prepared sample for measurement of light transmittance was placed in a glass cell filled with extra-pure water (optical path length 10 mm×optical path width 10 mm×height 45 mm, manufactured by SOGO LABORATORY GLASS WORKS CO., LTD.) and measured for its light transmittance in the measurement wavelength range of 300 to 900 nm with a spectrophotometer (UV-1600PC, manufactured by Shimadzu Corporation). In the measurement result of light transmittance, light transmittance per mm thickness was expressed by using the Lambert-Beer law. When the sample for measurement of light transmittance had a space between the light-transmitting region and the transparent support film, light transmittance was expressed per mm thickness including the thickness of the space.

Example 1

[Preparation of Polishing Region]

100 parts by weight of a polyether-based prepolymer (Adiprene L-325, NCO content: 2.22 meq/g, manufactured by Uniroyal) and 3 parts by weight of a silicone-based surfactant (SH192 manufactured by Toray Dow Corning Silicone Co., Ltd.) were mixed in a reaction container, and the temperature was regulated to 80° C. The mixture was stirred vigorously for about 4 minutes at a revolution number of 900 rpm by a stirring blade so as to incorporate bubbles into the reaction system. 26 parts by weight of 4,4'-methylene bis(o-chloroaniline) previously melted at 120° C. (Iharacuamine MT, manufactured by Ihara Chemical) was added thereto. Thereafter, the reaction solution was stirred for about 1 minute and poured into a pan-type open mold. When the fluidity of this reaction solution was lost, the reaction solution was introduced into an oven and post-cured at 110° C. for 6 hours to give a polyurethane foam block. This polyurethane foam block was sliced by a bandsaw-type slicer (manufactured by Fecken) to give a polyurethane foam sheet. Then, this sheet was surface-buffed to a predetermined thickness by a buffing machine (manufactured by Amitec) to give a sheet having regulated thickness accuracy (sheet thickness, 1.27 mm). This buffed sheet was punched into a round sheet having a diameter of 61 cm, and then provided with grooves in the form of concentric circles on the surface by a grooving machine (Toho Koki). An opening (57 mm×20 mm) for inserting a light-transmitting region was formed by punching in a predetermined position of this grooved sheet. A double-sided tape (Double Tack Tape #5782, manufactured by Sekisui Chemical Co., Ltd.: thickness: 130 μm, substrate: nonwoven fabric, adhesive: acrylic adhesive, aromatic ring density: 0%) was stuck by a laminator on the other side than the grooved surface of this sheet. Thereafter, the double-sided tape in the opening was punched out into a size of 51 mm×13 mm, to prepare a polishing region provided with a double-sided tape.

[Preparation of Light-transmitting Region]

770 parts by weight of 1,6-hexamethylenediisocyanate (hereinafter abbreviated as HDI) and 230 parts by weight of 1,3-butanediol (hereinafter abbreviated as 1,3-BG) were introduced into a container and heated at 80° C. for 120 minutes under stirring to prepare an isocyanate-terminated prepolymer A.

Separately, 29 parts by weight of polytetramethylene glycol having a number-average molecular weight of 650 (hereinafter abbreviated as PTMG-650), 13 parts by weight of trimethylol propane (hereinafter abbreviated as TMP) and 0.43 part by weight of a catalyst (Kao No. 25, manufactured by Kao Corporation) were mixed under stirring at 80° C. to give a liquid mixture. Thereafter, the isocyanate-terminated prepolymer A (100 parts by weight) was added to the liquid mixture regulated to a temperature of 80° C., then sufficiently stirred with a hybrid mixer (manufactured by Keyence Corporation) and then defoamed. This reaction liquid was dropped on a mold subjected to release treatment, then covered with a PET film subjected to release treatment, and regulated to be 1.25 nm in thickness with a nip roll. Thereafter, the mold was placed in an oven at 100° C. and post-cured for 16 hours to prepare a polyurethane sheet. The polyurethane sheet was punched out in a size of 57 mm×19 mm with a Thomson blade to prepare a light-transmitting region (a) (thickness: 1.25 mm).

[Preparation of Polishing Pad]

A polypropylene transparent support film (Pylen Film-OT P-2161, thickness 50 μm, aromatic ring density 0%, manufactured by Toyobo Co., Ltd.) was attached by a laminating machine to the polishing region provided with a double-sided tape. Thereafter, the light-transmitting region (a) was inserted into the opening of the polishing region and attached to the double-sided tape to prepare a polishing pad.

Example 2

A polishing pad was prepared in the same manner as in Example 1 except that a polypropylene transparent support film (Pylen Film-OT P-2002, thickness 50 μm, aromatic ring density 0%, manufactured by Toyobo Co., Ltd.) was used in place of Pylen Film-OT P-2161.

Example 3

A polishing pad was prepared in the same manner as in Example 1 except that a polyethylene transparent support film (Lix Film L6100, thickness 60 μm, aromatic ring density 0%, manufactured by Toyobo Co., Ltd.) was used in place of Pylen Film-OT P-2161.

Example 4

A polishing pad was prepared in the same manner as in Example 1 except that an aliphatic polyamide transparent support film (Harden Film N1100, thickness 25 μm, aromatic ring density 0%, manufactured by Toyobo Co., Ltd.) was used in place of Pylen Film-OT P-2161.

Example 5

[Preparation of Light-transmitting Region]

PTMG-650 (242 parts by weight), 1,3-BG (134 parts by weight) and HDI (625 parts by weight) were introduced into a container and heated at 80° C. for 120 minutes under stirring to prepare an isocyanate-terminated prepolymer B.

Separately, 1,3-BG (6 parts by weight), TMP (10 parts by weight) and 0.35 part by weight of a catalyst (Kao No. 25) were mixed under stirring at 80° C. to give a liquid mixture. Thereafter, the isocyanate-terminated prepolymer B (100 parts by weight) was added to the liquid mixture regulated to a temperature of 80° C., then sufficiently stirred with a hybrid mixer (manufactured by Keyence Corporation) and then defoamed. Thereafter, a light-transmitting region (b) (57 mm×19 mm, thickness: 1.25 mm) was prepared in the same manner as in Example 1.

[Preparation of Polishing Pad]

A polishing pad was prepared in the same manner as in Example 1 except that the light-transmitting region (b) was used in place of the light-transmitting region (a).

Example 6

[Preparation of Light-transmitting Region]

PTMG-650 (252 parts by weight), 1,3-BG (3 parts by weight) and 667 parts by weight of 4,4'-dicyclohexylmethanediisocyanate (hereinafter abbreviated as HMDI) were introduced into a container and heated at 80° C. for 120 minutes under stirring to prepare an isocyanate-terminated prepolymer C.

Separately, 1,3-BG (6 parts by weight), TMP (7 parts by weight) and 0.33 part by weight of a catalyst (Kao No. 25) were mixed under stirring at 80° C. to give a liquid mixture. Thereafter, the isocyanate-terminated prepolymer C (100 parts by weight) was added to the liquid mixture regulated to a temperature of 80° C., then sufficiently stirred with a hybrid mixer (manufactured by Keyence Corporation) and then defoamed. Thereafter, a light-transmitting region (c) (57 mm×19 mm, thickness: 1.25 mm) was prepared in the same manner as in Example 1.

[Preparation of Polishing Pad]

A polishing pad was prepared in the same manner as in Example 1 except that the light-transmitting region (c) was used in place of the light-transmitting region (a).

Example 7

[Preparation of Light-transmitting Region]

PTMG-650 (279 parts by weight), 1,3-BG (90 parts by weight) and 631 parts by weight of isophoronediisocyanate were introduced into a container and heated at 80° C. for 120 minutes under stirring to prepare an isocyanate-terminated prepolymer D.

Separately, 1,3-BG (7 parts by weight), TMP (5 parts by weight) and 0.34 part by weight of a catalyst (Kao No. 25) were mixed under stirring at 80° C. to give a liquid mixture. Thereafter, the isocyanate-terminated prepolymer D (100 parts by weight) was added to the liquid mixture regulated to a temperature of 80° C., then sufficiently stirred with a hybrid mixer (manufactured by Keyence Corporation) and then defoamed. Thereafter, a light-transmitting region (d) (57 mm×19 mm, thickness: 1.25 mm) was prepared in the same manner as in Example 1.

[Preparation of Polishing Pad]

A polishing pad was prepared in the same manner as in Example 1 except that the light-transmitting region (d) was used in place of the light-transmitting region (a).

Example 8

[Preparation of Light-transmitting Region]

Polytetramethylene glycol having a number-average molecular weight of 1000 (462 parts by weight), diethylene glycol (54 parts by weight) and HMDI (484 parts by weight) were introduced into a container and heated at 80° C. for 120 minutes under stirring to prepare an isocyanate-terminated prepolymer E.

Separately, 4 parts by weight of Ethacure 100 (mixture of 3,5-diethyl-2,6-toluenediamine and 3,5-diethyl-2,4-toluenediamine, manufactured by Albemarle), TMP (5 parts by weight) and 0.43 part by weight of a catalyst (Kao No. 25) were mixed under stirring at 80° C. to give a liquid mixture. Thereafter, the isocyanate-terminated prepolymer E (100 parts by weight) was added to the liquid mixture regulated to a temperature of 80° C., then sufficiently stirred with a hybrid mixer (manufactured by Keyence Corporation) and then defoamed. Thereafter, a light-transmitting region (e) (57 mm×19 mm, thickness: 1.25 mm) was prepared in the same manner as in Example 1.

[Preparation of Polishing Pad]

A polishing pad was prepared in the same manner as in Example 1 except that the light-transmitting region (e) was used in place of the light-transmitting region (a).

Example 9

[Preparation of Polishing Region]

A polishing region provided with a double-sided tape was prepared in the same manner as in Example 1 except that the double-sided tape in the opening was not punched out.

[Preparation of Polishing Pad]

A polishing pad was prepared in the same manner as in Example 1 except that the above polishing region provided with a double-sided tape was used in place of the polishing region provided with a double-sided tape in Example 1.

Comparative Example 1

A polishing pad was prepared in the same manner as in Example 1 except that a polyethylene terephthalate transparent support film (Toyobo Ester Film E5001, thickness 100 μm, aromatic ring density 38%, manufactured by Toyobo Co., Ltd.) was used in place of Pylen Film-OT P-2161.

Comparative Example 2

[Preparation of Light-transmitting Region]

100 parts by weight of a polyether-based prepolymer (Adiprene L-325, NCO content: 2.22 meq/g, manufactured by Uniroyal) was weighed in a decompression tank, and the gas remaining in the prepolymer was defoamed under reduced pressure (about 10 Torr). 29 parts by weight of 4,4'-methylene bis(o-chloroaniline) previously melted at 120° C. was added to the defoamed prepolymer, then sufficiently stirred with a hybrid mixer (manufactured by Keyence Corporation) and then defoamed. Thereafter, a light-transmitting region (f) (57 mm×19 mm, thickness: 1.25 mm) was prepared in the same manner as in Example 1.

[Preparation of Polishing Pad]

A polishing pad was prepared in the same manner as in Example 1 except that the light-transmitting region (f) was used in place of the light-transmitting region (a).

TABLE 1

| | Aromatic ring density (%) | Light transmittance (%) | | | | | | | |
|---|---|---|---|---|---|---|---|---|---|
| | in optical detection region | 300 nm | 350 nm | 400 nm | 500 nm | 600 nm | 700 nm | 800 nm | 900 nm |
| Example 1 | 0 | 69.2 | 85.2 | 94.1 | 95.8 | 96.2 | 96.4 | 96.5 | 96.5 |
| Example 2 | 0 | 65.7 | 81.2 | 92.6 | 94.3 | 95.6 | 96.1 | 96.2 | 96.2 |
| Example 3 | 0 | 63.9 | 79.1 | 93.1 | 94.6 | 95.0 | 95.2 | 95.2 | 95.2 |
| Example 4 | 0 | 67.2 | 80.2 | 90.7 | 93.4 | 93.8 | 93.9 | 93.9 | 93.9 |
| Example 5 | 0 | 70.4 | 86.1 | 93.6 | 94.9 | 94.9 | 95.0 | 95.0 | 95.0 |
| Example 6 | 0 | 64.3 | 80.9 | 91.2 | 94.1 | 94.3 | 94.3 | 94.3 | 94.3 |
| Example 7 | 0 | 68.1 | 83.9 | 91.8 | 93.5 | 93.7 | 93.7 | 93.7 | 93.7 |
| Example 8 | 1.4 | 50.1 | 75.2 | 88.1 | 93.5 | 93.7 | 93.9 | 93.9 | 93.9 |
| Example 9 | 0 | 54.3 | 73.1 | 85.6 | 86.7 | 86.9 | 87.1 | 87.2 | 87.2 |
| Comparative Example 1 | 2.8 | 0 | 70.1 | 84.3 | 90.1 | 91.6 | 91.6 | 91.6 | 91.7 |
| Comparative Example 2 | 21.4 | 0 | 2.1 | 50.6 | 80.1 | 85.9 | 89.6 | 91.2 | 92.6 |

As can be seen from Table 1, the polishing pads of the present invention have very high light transmittance at the short-wavelength side and are thus superior in optical detection accuracy to the conventional polishing pads.

The invention claimed is:

1. A polishing pad comprising at least a transparent support film laminated on one side of a polishing layer including a polishing region and a light-transmitting region, wherein the light transmittance of an optical detection region containing at least the light-transmitting region and the transparent support film is 40% or more in the overall range of wavelengths of 300 to 400 nm, and wherein the density of aromatic rings in a polymer as a main material of each member constituting the optical detection region is 2 wt % or less in total.

2. The polishing pad according to claim 1, wherein the polymer as a main material of the light-transmitting region is a polyurethane resin, and an isocyanate component of the polyurethane resin is at least one member selected from the group consisting of 1,6-hexamethylenediisocyanate, 4,4'-dicyclohexylmethanediisocyanate, and isophoronediisocyanate.

3. The polishing pad according to claim 1, wherein the polymer as a main material of the transparent support film is at least one member selected from the group consisting of polypropylene, polyethylene, aliphatic polyamide, polymethyl acrylate, polymethyl methacrylate, and polyvinyl chloride.

4. A method for manufacturing a semiconductor device, which comprises a process of polishing the surface of a semiconductor wafer with the polishing pad according to claim 1, 2, or 3.

* * * * *